US005150484A

United States Patent [19]

Whitten, Jr.

[11] Patent Number: 5,150,484

[45] Date of Patent: Sep. 29, 1992

[54] SUPPORT STRUCTURE FOR BEDS AND THE LIKE

[76] Inventor: Gordon Whitten, Jr., 1120 Saunders St., Hastings, Nebr. 68901

[21] Appl. No.: 566,132

[22] Filed: Aug. 13, 1990

[51] Int. Cl.[5] ..... A47C 19/00

[52] U.S. Cl. ..... 5/9.1; 182/128; 211/189

[58] Field of Search ..... 182/128, 179; 52/36; 248/172, 670; 211/189; 5/9.1, 508

[56] References Cited

U.S. PATENT DOCUMENTS

| | | | |
|---|---|---|---|
| 631,962 | 8/1899 | Lein . | |
| 665,535 | 1/1901 | Lein . | |
| 669,175 | 3/1901 | Lein . | |
| 822,592 | 6/1906 | Dowling . | |
| 860,941 | 7/1907 | Rodrigues . | |
| 958,895 | 5/1910 | Rodrigues . | |
| 982,997 | 1/1911 | Russell . | |
| 1,001,946 | 8/1911 | Gumm . | |
| 1,089,545 | 3/1914 | Gosso . | |
| 1,195,637 | 8/1916 | Anderson . | |
| 1,253,549 | 1/1918 | Weaver . | |
| 1,325,320 | 12/1919 | Gosso . | |
| 1,349,962 | 8/1920 | Janson et al. . | |
| 3,071,204 | 6/1963 | Piltingsrod | 182/179 |
| 3,215,387 | 11/1965 | Thompson et al. . | |
| 3,506,136 | 4/1970 | Burda | 211/189 |
| 3,520,345 | 7/1970 | Lillibridge | 52/36 |
| 3,834,549 | 9/1974 | Burg | 211/189 |
| 3,858,254 | 1/1975 | Coomes | 5/8 |
| 4,004,653 | 1/1977 | Hass | 182/128 |
| 4,084,276 | 4/1978 | Trexler, Jr. et al. | 5/118 |

FOREIGN PATENT DOCUMENTS

| | | | |
|---|---|---|---|
| 302245 | 10/1932 | Italy | 5/9.1 |
| 81953 | 6/1953 | Norway | 5/9.1 |
| 25055 | 7/1908 | Sweden | 52/36 |
| 238759 | 10/1969 | U.S.S.R. | 182/128 |

*Primary Examiner*—Gary L. Smith
*Assistant Examiner*—F. Saether
*Attorney, Agent, or Firm*—John A. Beehner

[57] ABSTRACT

A load bearing scaffold adapted to disperse load forces to interior room surfaces. The load bearing scaffold includes a pair of generally parallel telescopically adjustable horizontal beams. The horizontal beams are supported on at least one end by at least one pair of generally parallel vertical beams. The vertical beams are interconnected in spaced apart relation by at least one cross bar. The scaffold is assembled so that the vertical beams and cross bar abut against one wall while the horizontal beams abut against the ceiling and opposite wall. Articles may be supported by being suspended from the vertical beams or horizontal beams of the scaffold.

10 Claims, 2 Drawing Sheets

SUPPORT STRUCTURE FOR BEDS AND THE LIKE

BACKGROUND OF THE INVENTION

1. Technical Field

The present invention is directed to load bearing scaffolds and more particularly to load bearing scaffolds adapted to derive at least some of their support from the interior surfaces of a room.

2. Description of the Prior Art

Load bearing scaffolds are well known in the construction arts. Such scaffolds are generally adapted for supporting workmen, construction equipment, and building materials.

Also known are bunks and berths adapted to provide sleeping accommodations for passengers, military personnel, students, or small children. These apparatus are often adapted to be supported from poles anchored to the floor and ceiling of a room. For example, apparatus of this general species are disclosed by Lein, U.S. Pat. No. 665,535; Rodrigues, U.S. Pat. No. 958,895; Gosso, U.S. Pat. No. 1,325,320; and Gosso, U.S. Pat. No. 1,089,545.

Also known to the art are bunks or berths adapted to be supported by anchoring the bunk or berth to a wall. For example, apparatus of this general species are disclosed by Lein, U.S. Pat. No. 669,175; Dowling, U.S. Pat. No. 822,592; Rodrigues, U.S. Pat. No. 860,941; Gumm, U.S. Pat. No. 1,001,946; Thompson, et al., U.S. Pat. No. 3,215,387; Coomes, U.S. Pat. No. 3,858,254; and Trexler, Jr., et al., U.S. Pat. No. 4,084,276.

Inventions of this type are unsuitable for the present objects since their installation requires that they become room fixtures. Additionally, such bunks or berths necessarily require the dedication of otherwise useful floor space.

Free standing bunk beds are also known to the bunk and berth art. Examples of this type of bed may be found disclosed by Lein, U.S. Pat. No. 631,962; Anderson, U.S. Pat. No. 1,195,637; Weaver, U.S. Pat. No. 1,253,549; and Janson, et al., U.S. Pat. No. 1,349,962.

Bunks or berths of this type are also incapable of performing the objects of the present invention in that they require otherwise livable space to be dedicated solely to their use.

3. Objects of the Invention

Many educational institutions provide dormitories in order to accommodate students who are required to live on campus. Dormitories are generally multistory buildings having a central elevator and stairway corridor. On either side of the central area is a hallway having a plurality of small rooms located on either side of the hallway. These small rooms generally do not have bathrooms.

Each room has a small closet and is usually furnished with two single beds, two desks, two lamps, two chairs, and a dresser or bureau. Even though each room contains a minimal amount of furniture, the rooms are small, and space is at a premium.

Since these rooms are small and sparse it is difficult for two people to live comfortably within the room. This is true since most dorm rooms lack sufficient space to maintain a stereo, television, small refrigerator, or to store a bicycle and the like.

Students desiring a more livable environment often remove their beds or make the existing two single beds into a lower and upper berth bunk bed. With the same goal in mind students also replace their beds with futon mattresses.

The primary object of the present invention is to provide an improved load bearing scaffold capable of dispersing load forces to the floor and other surfaces of a room.

Another object of the present invention is to provide a load bearing scaffold that does not require the scaffold to be attached to the room infrastructure or superstructure.

Another object of the present invention is to provide a load bearing scaffold that will not damage room surfaces.

Another object of the present invention is to provide a load bearing scaffold that is easy to assemble and disassemble.

Another object of the present invention is to provide a load bearing scaffold that is safe to use and durable in construction.

Another object of the present invention is to provide a load bearing scaffold that is low in cost and easy to manufacture.

Another object of the present invention is to provide an adjustable load bearing scaffold adapted to fit in any sized room.

Another object of the present invention is to provide a load bearing scaffold that frees existing floor space.

Finally, another object of the present invention is to provide a load bearing scaffold capable of supporting beds, desks, shelves, and the like.

SUMMARY OF THE INVENTION

The present invention provides a load bearing scaffold adapted to disperse load forces to interior room surfaces. The load bearing scaffold includes a pair of generally parallel telescopically adjustable horizontal beams.

The horizontal beams are supported on at least one end by at least one pair of generally parallel vertical beams. The vertical beams are interconnected in spaced apart relation by at least one cross bar.

The scaffold is adjustably assembled so that the vertical beams and cross bar abut against one wall while the horizontal beams abut against the ceiling and opposite wall. Articles may be supported by being suspended from the vertical beams or horizontal beams of the scaffold.

DESCRIPTION OF THE PREFERRED EMBODIMENT

Figure 1:
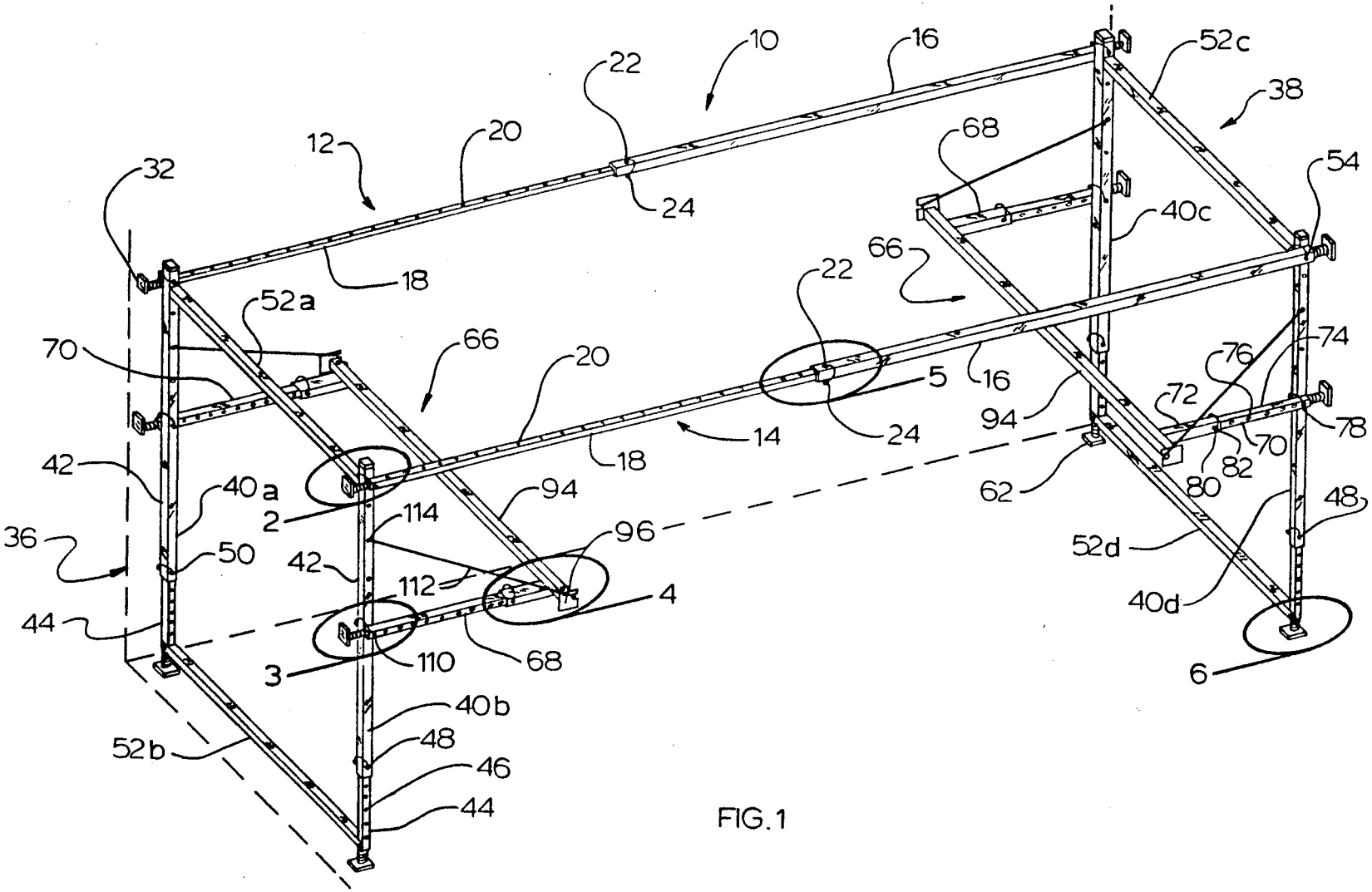
FIG. 1 is a perspective view of a preferred embodiment of the load bearing scaffolding adapted for supporting two single beds within a dormitory room.

A preferred embodiment of the present invention 10 is illustrated in FIGS. 1 through 6.

The preferred embodiment of the present invention 10 is designed for use in dormitory rooms and the like. The scaffold support apparatus 10 consists of a first telescoping horizontal beam assembly 12 and a second horizontal beam assembly 14. Both the first 12 and second 14 horizontal beam assemblies have a hollow guide post 16 and a hollow arm 18 adapted to slidably extend from and retract into the hollow guide post 16.

Figure 2:
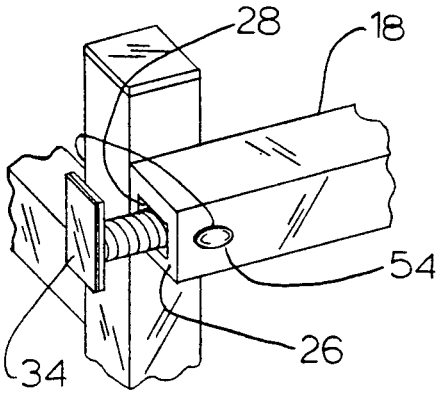
FIG. 2 is an enlarged perspective view taken at area 2 of FIG. 1 showing a vertical, horizontal, and cross beam joint of a preferred embodiment of the load bearing scaffold.

In a preferred embodiment the guide posts 16 are fabricated from 1.25 inch square tubing. The arms 18 are fabricated from 1.00 inch square tubing. The arms 18 have a plurality of spaced apart adjustment holes 20 formed therethrough. In a preferred embodiment the adjustment holes are spaced 4.00 inches apart. Also included are vertical beam anchor holes 22 formed through the end of each guide post 16 and arm 18 (FIG. 2). Formed through the guide post 16 is an adjustment pin hole 22.

Figure 5:
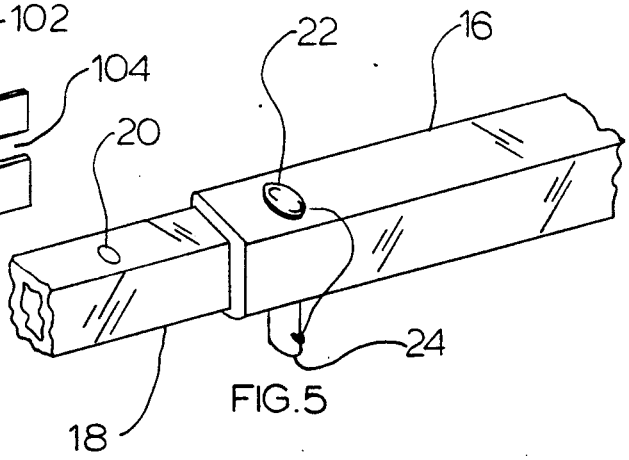
FIG. 5 is an enlarged perspective view taken at area 5 of FIG. 1 showing a telescoping horizontal beam joint of a preferred embodiment of the load bearing scaffold.

An arm 18 may be slidably engaged by a guide post 16 and a pin 24 may be passed through the adjustment pin hole 22 and an adjustment hole 20 so as to create a horizontal beam assembly (12 and 14) of a particular length (FIG. 5).

The ends of each of the horizontal beam assemblies are covered by an end plate 26 having a threaded hole 28 formed therethrough (FIG. 2). The hole 28 of each end of the assemblies (12 and 14) are adapted to threadably engage a fine adjustment bolt 30. Mounted to the end of each bolt 30 is a wall plate 32. Each wall plate has a rubberized wall pad 34 fixed thereto.

In a preferred embodiment the scaffold support apparatus 10 aIso includes a first vertical support beam assembly 36 and a second vertical support beam assembly 38.

Each vertical support assembly (36 and 38) consists of a pair of vertical support beams (40*a*, 40*b*, 40*c*, and 40*d*). Each vertical support beam 40 consists of a hollow guide post 42 and a hollow arm 44 adapted to slidably extend from and retract into the hollow guide post 42 (FIG. 1).

In a preferred embodiment the guide posts 42 are fabricated from 1.25 inch square tubing. The arms 44 are fabricated from 1.00 inch square tubing. The arms 44 have a plurality of spaced apart adjustment holes 46 formed therethrough. In a preferred embodiment the adjustment holes are spaced 4.00 inches apart. Also included are horizontal beam anchor holes 48 formed through the end of each guide post 42 and arm 44 (FIG. 2). Formed through the guide post 42 is an adjustment pin hole 50.

An arm 44 may be slidably engaged by a guide post 42 and a pin 50 may be passed through the adjustment pin hole 50 and an adjustment hole 46 so as to create a vertical support beam (40*a*, 40*b*, 40*c*, and 40*d*) of a particular length (FIG. 1).

Welded between the top and bottom ends of a first pair of vertical support beams 40*a* and 40*b* are a pair of first cross members 52*a* and 52*b* forming a first vertical support assembly 36. Welded between the top and bottom ends of a first pair of vertical support beams 40*c* and 40*d* are a pair of first cross members 52*c* and 52*d* forming a second vertical support assembly 38.

The first 36 and second 38 vertical support assemblies are utilized to vertically support the first 12 and second 14 horizontal beam assemblies. FIG. 2 illustrates a preferred apparatus for anchoring the horizontal beam assemblies (12 and 14) to the first 36 and second 38 vertical support assemblies.

As is illustrated by FIG. 2 the vertical beam anchor holes 22 are matched with the horizontal beam anchor holes 48 and a pin 54 may then be used to anchor the vertical and horizontal assemblies together.

Figure 6:
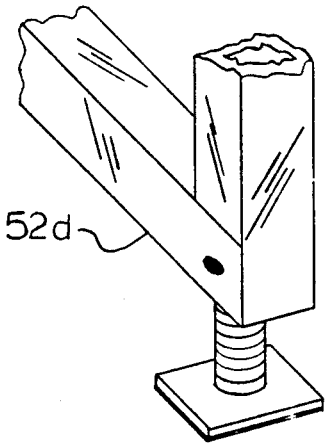
FIG. 6 is an enlarged perspective view taken at area 6 of FIG. 1 showing a floor leveling castor of a preferred embodiment of the load bearing scaffold.

The bottom end of each of the vertical beams (40*a*, 40*b*, 40*c*, and 40*d*) is covered by an end plate 56 having a threaded hole 58 formed therethrough (FIG. 6). The hole 58 of each end of the vertical beams (40*a*, 40*b*, 40*c*, and 40*d*) is adapted to threadably engage a fine adjustment bolt 60. Mounted to the end of each bolt 60 is a wall plate 62. Each wall plate has a rubberized wall pad 64 fixed thereto.

Figure 4:
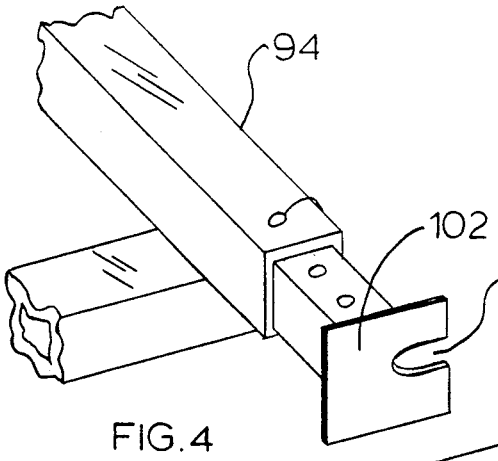
FIG. 4 is an enlarged perspective view taken at area 4 of FIG. 1 showing a cross bar and horizontal bar support joint and cable attachment plate of a preferred embodiment of the load bearing scaffold.

A bed support assembly 66 may be connected to each of the vertical support assemblies (36 and 38). Each bed support assembly 66 consists of a first telescoping horizontal bar assembly 68 and a second horizontal bar assembly 70. Both the first 68 and second 70 horizontal bar assemblies have a hollow guide post 72 and a hollow arm 74 adapted to slidably extend from and retract into the hollow guide post 72 (FIG. 4).

Figure 3:
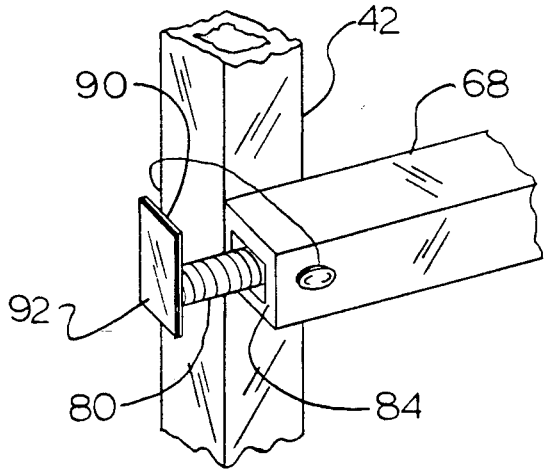
FIG. 3 is an enlarged perspective view taken at area 3 of FIG. 1 showing a vertical beam and horizontal bar joint and a wall support pad of a preferred embodiment of the load bearing scaffold.

In a preferred embodiment the guide posts 72 are fabricated from 1.25 inch square tubing. The arms 74 are fabricated from 1.00 inch square tubing. The arms 72 have a plurality of spaced apart adjustment holes 76 formed therethrough. In a preferred embodiment the adjustment holes are spaced 4.00 inches apart. Also included are vertical beam anchor holes 78 formed through the end of each arm 18 (FIG. 3). Formed through the guide post 72 is an adjustment pin hole 80.

An arm 74 may be slidably engaged by a guide post 72 and a pin 82 may be passed through the adjustment pin hole so and an adjustment hole 76 so as to create a horizontal bar assembly (68 and 70).

The ends of each of the horizontal bar assemblies are covered by an end plate 84 having a threaded hole 86 formed therethrough (FIG. 3). The hole 86 of each end of the assemblies (68 and 70) are adapted to threadably engage a fine adjustment bolt 88. Mounted to the end of each bolt 88 is a wall plate 90. Each wall plate has a rubberized wall pad 92 fixed thereto.

The opposing ends of a bed support cross bar 94 are welded on top of the end of any two guide posts 72 of the horizontal bar assemblies (68 and 70) (FIG. 4). The ends of each of the horizontal bar assemblies are covered by an end plate 96 having a threaded hole 98 formed therethrough (FIG. 4) The hole 98 of each end of bed support cross bar 94 is adapted to threadably engage a fine adjustment bolt 100. Mounted to the end of each bolt 100 is a support plate 102 having a cable hole 104 formed therethrough.

Each bed support assembly 66 may be suspended from a vertical support assembly 36 and 38 (FIGS. 3, and 4). As is illustrated by FIG. 3 a bed support anchor hole 106 formed through the vertical support beams (40*a*, 40*b*, 40*c*, and 40*d*) is matched with a horizontal bar anchor hole 108 and a pin 110 may then be used to anchor a bed support assembly 66 to a vertical support assembly (36 and 38). A cable 112 may then be mounted between vertical beam cable hole 114 and cable hole 104 (FIG. 4).

It is apparent that pins 24, 50, 54, 82, and 110 may be interchangeable. Likewise, the wall pad support assemblies and feet are also interchangeable. The entire structure may be powder coated or protected by a layer of paint.

While the invention has been described with a certain degree of particularity, it is manifest that many changes may be made in the details of construction and the arrangement of components without departing from the spirit and scope of the disclosure. For example, the apparatus may be adapted to support desks, shelves, planters, bicycles, televisions, or stereos.

It is understood that the invention is not limited to the embodiments set forth herein for purposes of exemplification, but is to be limited only by the scope of the attached claims including the full range of equivalency to which each element thereof is entitled.

Thus, there has been shown and described a support structure for beds and the like which accomplishes at least all of the stated objects.

I claim:

1. A load bearing scaffold adapted to be supported on the floor of a room and to extend between opposite walls thereof for supporting articles, comprising:

a pair of vertical support beams adapted to be supported on a floor adjacent one wall;

a horizontal beam connected adjacent one end to and extending generally horizontally outwardly from at least one of said vertical support beams to resist movement of the vertical support beam toward an opposite wall;

means for adjusting the length of said horizontal beam wherein said means comprises a combination of a horizontal gross adjustment means whereby said horizontal beam may be adjusted to fit approximately between said opposite walls of a room, and a horizontal fine adjustment means, whereby said horizontal beam may be further adjusted to substantially engage said opposite walls of a room;

means for adjusting the length of said vertical beams wherein said means comprises a combination of a vertical gross adjustment means, whereby said vertical beams may be adjusted to change the height of the articles, and a vertical fine adjustment means, whereby said vertical beams may be adjusted to make fine changes in the height of the articles; and a platform means supported on said vertical support beams and extending outwardly therefrom toward said opposite wall.

2. The load bearing scaffold of claim 1, wherein said platform means further comprises:

a platform; and a tension member interconnected between said vertical members and said platform.

3. The loading bearing scaffold of claim 1, wherein said scaffold comprises:

a second horizontal beam connected adjacent one end to and extending generally horizontally outwardly from the other of said vertical support beams;

a second pair of generally parallel vertical beams connected adjacent opposite ends of said pair of generally parallel horizontal beams; and at least one cross bar for interconnecting each pair of said generally parallel vertical beams in spaced relation.

4. The load bearing scaffold of claim 3, wherein said platform comprises:

at least two horizontal bed support bars in substantially parallel, spaced-apart relation having first and second opposing ends;

a horizontal crossbar;

means for connecting said second ends of said bed support bars to said cross bar whereby said bed support bars are substantially perpendicular to said crossbar;

means for connecting said first end of each of said bed support bars to said vertical support beam adjacent to each said first end; and means for supporting said cross bar and said bed support bars in a plane generally parallel to the floor of said room.

5. The load bearing scaffold of claim 4, further comprising means for adjusting the height of said platform in relation to the floor of said room.

6. The load bearing scaffold of claim 4, further comprising means for adjusting said platform to accommodate beds of different dimensions.

7. The load bearing scaffold of claim 1, wherein said horizontal gross adjustment means is a telescoping joint.

8. The load bearing scaffold of claim 7, wherein said horizontal fine adjustment means is a threaded bolt.

9. The load bearing scaffold of claim 8, wherein said vertical gross adjustment means is a telescoping joint.

10. The load bearing scaffold of claim 9 wherein said vertical fine adjustment means is a threaded bolt.

* * * * *